US005737785A

United States Patent [19]

Casey

[11] Patent Number: 5,737,785

[45] Date of Patent: Apr. 14, 1998

[54] BLANKET WITH POCKETS

[76] Inventor: Kevin M. Casey, 9200 Ambassador Pl., Philadelphia, Pa. 19115

[21] Appl. No.: 783,349

[22] Filed: Jan. 16, 1997

[51] Int. Cl.[6] ..... A47G 9/06

[52] U.S. Cl. ..... 5/419; 5/417; 5/485

[58] Field of Search ..... 5/417–420, 485

[56] References Cited

U.S. PATENT DOCUMENTS

| | | | |
|---|---|---|---|
| 4,466,516 | 8/1984 | Sicoli | 5/419 |
| 5,210,891 | 5/1993 | Avital | 5/419 |
| 5,454,125 | 10/1995 | Ratkowski | 5/417 |
| 5,463,783 | 11/1995 | Pope | 5/417 |
| 5,481,767 | 1/1996 | Lewis | 5/419 |

FOREIGN PATENT DOCUMENTS

| | | | |
|---|---|---|---|
| 1044391 | 11/1953 | France | 5/419 |
| 253404 | 6/1926 | United Kingdom | 5/485 |
| 2198348 | 6/1988 | United Kingdom | 5/485 |

*Primary Examiner*—Flemming Saether

[57] ABSTRACT

A new Blanket With Pockets for providing a means for securely storing and carrying loose items to and from the beach or swimming pool. The inventive device includes a blanket, a plurality of side pockets and a pillow pocket along the side and top edges of the blanket, respectively, and a securing/carrying strap. The blanket has top and bottom surfaces, top and bottom edges, and side edges. The plurality of side pockets are provided on the top surface along the side edges of the blanket. Each of the side pockets has a side pocket opening which is securely closed by a side pocket closure. A pillow pocket for receiving and retaining a pillow is provided on the top surface along the top edge of the blanket. Additional pillow pockets may be provided on the top surface along the top edge of the blanket as well as on the top surface along the bottom edge of the blanket. The pillow pocket has a pillow pocket opening which is securely closed by a pillow pocket closure. A securing strap is attached to the bottom surface of the blanket. When the present invention is folded and the ends of the securing strap are fastened together, the securing strap defines a carrying strap.

13 Claims, 5 Drawing Sheets

BLANKET WITH POCKETS

BACKGROUND OF THE INVENTION

1. Field of the Invention

The present invention relates to pocket-containing towels and blankets and more particularly pertains to a new Blanket With Pockets for providing a means for securely storing and carrying loose items to and from the beach or swimming pool.

2. Description of the Prior Art

The use of pocket-containing towels and blankets is known in the prior art. More specifically, pocket-containing towels and blankets heretofore devised and utilized are known to consist basically of familiar, expected and obvious structural configurations, notwithstanding the myriad of designs encompassed by the crowded prior art which have been developed for the fulfillment of countless objectives and requirements.

Known prior art pocket-containing towels and blankets include U.S. Pat. No. 5,443,880; U.S. Pat. No. 5,361,435; U.S. Pat. No. D341,285; U.S. Pat. No. 5,406,659; U.S. Pat. No. 5,261,131 and U.S. Pat. No. 4,546,507.

While these devices fulfill their respective, particular objectives and requirements, the aforementioned patents do not disclose a new Blanket With Pockets. The inventive device includes a blanket, a plurality of side pockets and a pillow pocket along the side and top edges of the blanket, respectively, and a securing/carrying strap.

In these respects, the Blanket With Pockets according to the present invention substantially departs from the conventional concepts and designs of the prior art, and in so doing provides an apparatus primarily developed for the purpose of providing a means for securely storing and carrying loose items to and from the beach or swimming pool.

SUMMARY OF THE INVENTION

In view of the foregoing disadvantages inherent in the known types of pocket-containing towels and blankets now present in the prior art, the present invention provides a new Blanket With Pockets construction wherein the same can be utilized for providing a means for securely storing and carrying loose items to and from the beach or swimming pool.

The general purpose of the present invention, which will be described subsequently in greater detail, is to provide a new Blanket With Pockets apparatus and method which has many of the advantages of the pocket-containing towels and blankets mentioned heretofore and many novel features that result in a new Blanket With Pockets which is not anticipated, rendered obvious, suggested, or even implied by any of the prior art pocket-containing towels and blankets, either alone or in any combination thereof.

To attain this, the present invention generally comprises a blanket, a plurality of side pockets and a pillow pocket along the side and top edges of the blanket, respectively, and a securing/carrying strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Blanket With Pockets apparatus and method which has many of the advantages of the pocket-containing towels and blankets mentioned heretofore and many novel features that result in a new Blanket With Pockets which is not anticipated, rendered obvious, suggested, or even implied by any of the prior art pocket-containing towels and blankets, either alone or in any combination thereof.

It is another object of the present invention to provide a new Blanket With Pockets which may be easily and efficiently manufactured and marketed.

It is a further object of the present invention to provide a new Blanket With Pockets which is of a durable and reliable construction.

An even further object of the present invention is to provide a new Blanket With Pockets which is susceptible of a low cost of manufacture with regard to both materials and labor, and which accordingly is then susceptible of low prices of sale to the consuming public, thereby making such Blanket With Pockets economically available to the buying public.

Still yet another object of the present invention is to provide a new Blanket With Pockets which provides in the apparatuses and methods of the prior art some of the advantages thereof, while simultaneously overcoming some of the disadvantages normally associated therewith.

Still another object of the present invention is to provide a new Blanket With Pockets for providing a means for securely storing and carrying loose items to and from the beach or swimming pool.

Yet another object of the present invention is to provide a new Blanket With Pockets which includes a blanket, a plurality of side pockets and a pillow pocket along the side and top edges of the blanket, respectively, and a securing/carrying strap.

Still yet another object of the present invention is to provide a new Blanket With Pockets that includes multiple pockets for organized storage of loose items.

Even still another object of the present invention is to provide a new Blanket With Pockets that can be easily folded and carried.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an illustration of a first fold of the present invention.

FIG. 5 is an illustration of a second fold of the present invention.

FIG. 6 is an illustration of the present invention after three folds.

FIG. 7 is an illustration of the present invention after four folds.

DESCRIPTION OF THE PREFERRED EMBODIMENT

Figure 1:
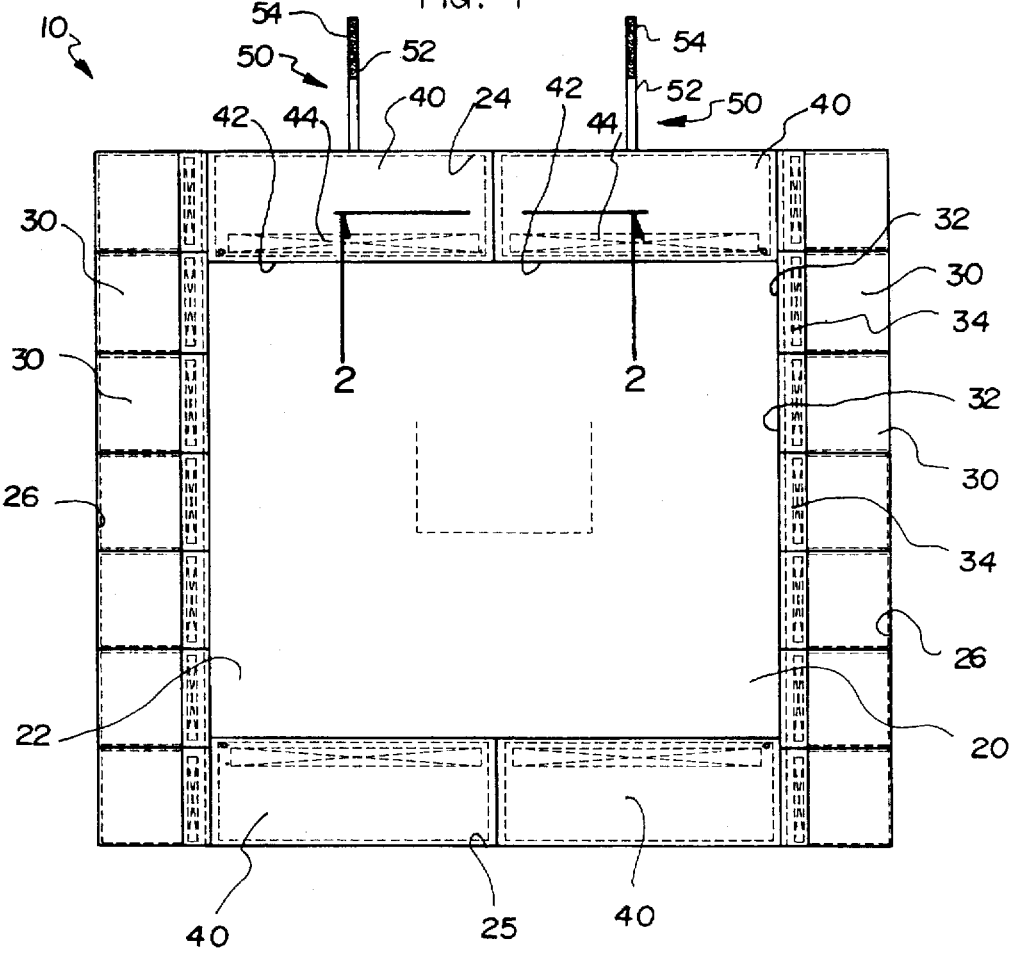
FIG. 1 is an illustration of a new Blanket With Pockets according to the present invention.
Figure 2:
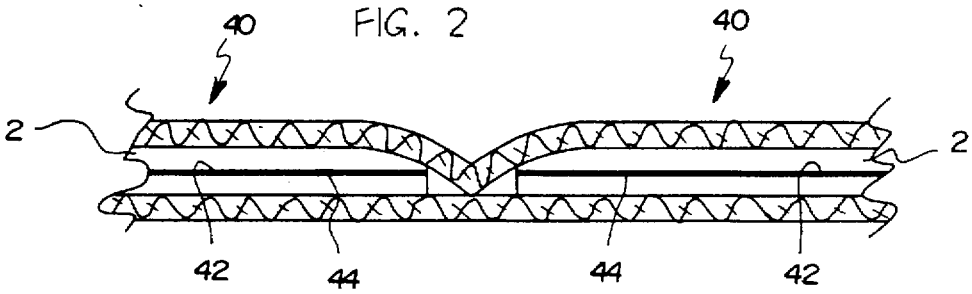
FIG. 2 is a cross sectional view of the pillow pockets taken along line 2—2 of FIG. 1.

With reference now to the drawings, and in particular to FIGS. 1 through 8 thereof, a new Blanket With Pockets embodying the principles and concepts of the present invention and generally designated by the reference numeral 10 will be described.

More specifically, it will be noted that the Blanket With Pockets 10 comprises a blanket 20, a plurality of side pockets 30, a pillow pocket 40, and a securing strap 50 which further defines a carrying strap 56. The blanket 20 has a top surface 22, a bottom surface 23, a top edge 24, a bottom edge 25, and side edges 26. The plurality of side pockets 30 are provided on the top surface 22 along the entire length of the side edges 26 of the blanket 20. The side pockets 30 are generally rectangular in shape and are closed along three sides thereof. Each of the side pockets 30 has a side pocket opening 32 which is securely closed by a side pocket closure 34. The side pocket closure 34 is formed of a hook and loop fastener (i.e., Velcro).

Figure 3:
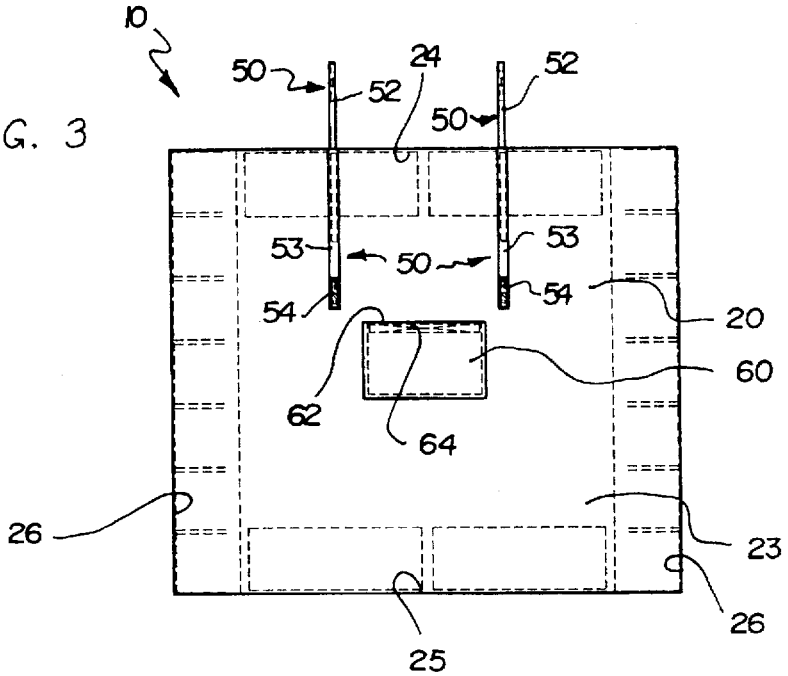
FIG. 3 is an illustration of the bottom surface of the present invention.
Figure 4:
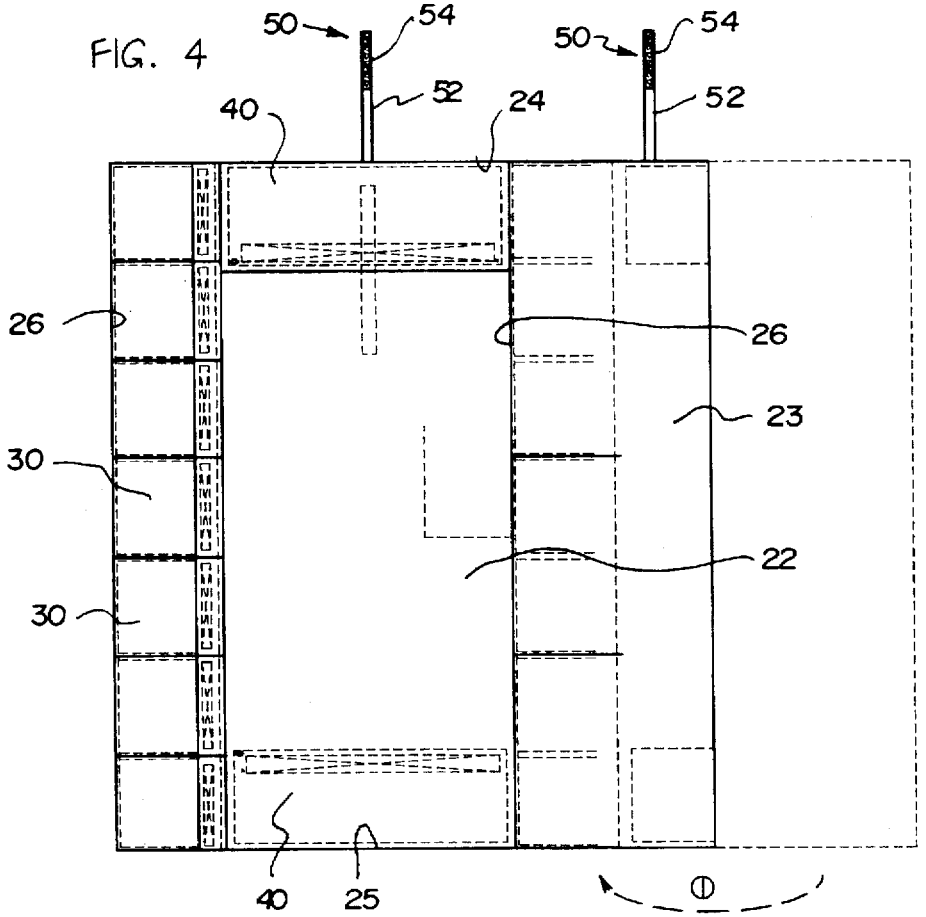
FIGS. 4 through 7 provide an illustration of the folding procedures of the present invention.
Figure 5:
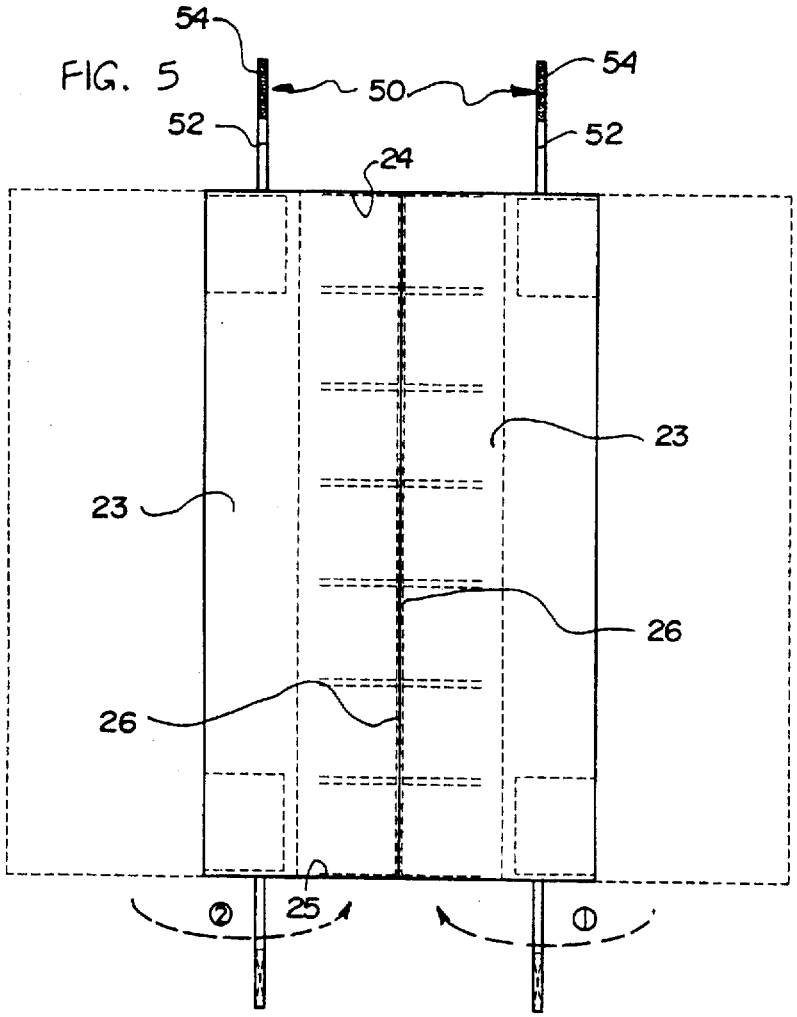
Figure 6:
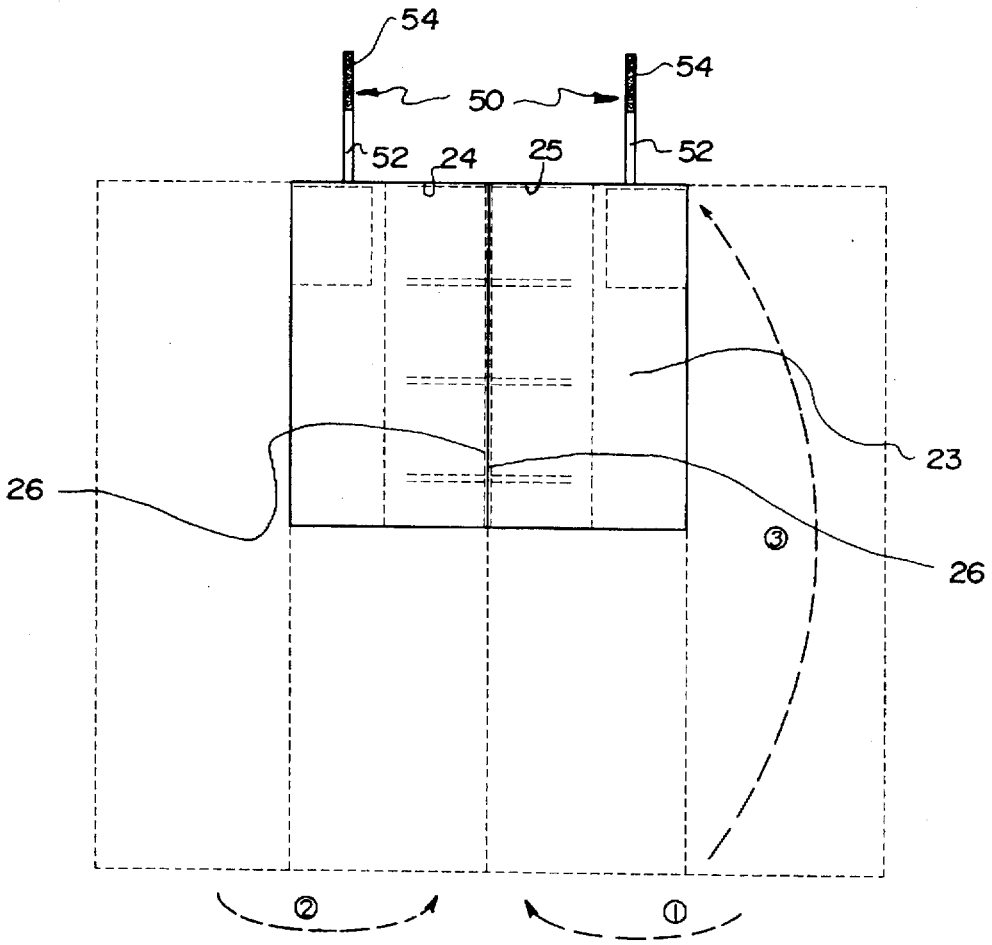
Figure 7:
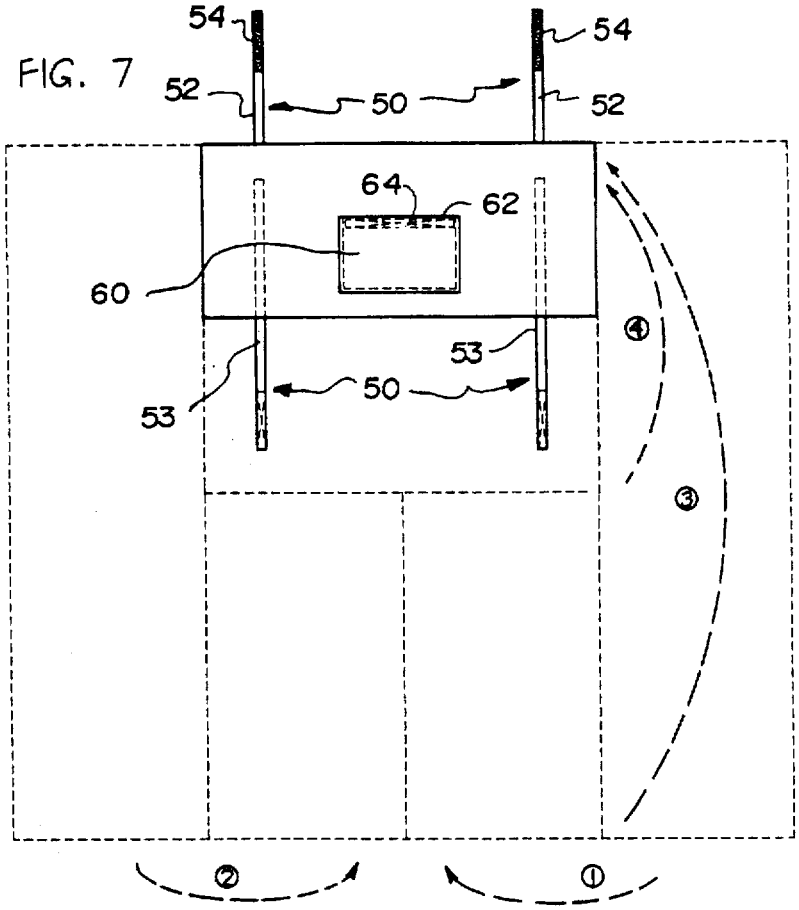

A pillow pocket 40 for receiving and retaining a pillow 2 is provided on the top surface 22 along the top edge 24 of the blanket 20. As best illustrated in FIG. 1, it can be shown that additional pillow pockets 40 may be provided on the top surface 22 along the top edge 24 of the blanket 20 as well as on the top surface 22 along the bottom edge 23 of the blanket 20. The pillow pocket 40 is generally rectangular in shape and closed along three sides thereof. The pillow pocket 40 has a pillow pocket opening 42 which is securely closed by a pillow pocket closure 44. The pillow pocket closure 44 is formed of a hook and loop fastener (i.e., Velcro). As best illustrated in FIG. 3, it can be shown that a bottom surface pocket 60 may be provided on the bottom surface 23 of the blanket 20. The bottom surface pocket 60 has a bottom surface pocket opening 62 and a bottom surface pocket closure 64 which is formed of a hook and loop fastener (i.e., Velcro).

Figure 8:
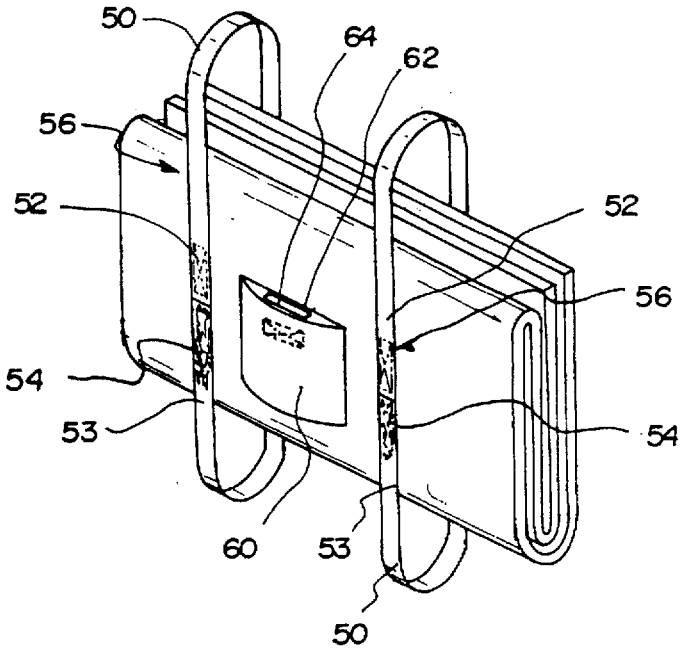
FIG. 8 is an illustration of the carrying strap defined by joining the ends of the securing strap.

The securing strap 50 is attached to the bottom surface 23 of the blanket 20. A first end 52 of the securing strap 50 extends beyond the top edge 24 of the blanket 20 and a second end 53 extends under the bottom surface 23 of the blanket 20. Provided on the first and second ends 52, 53 is a securing strap fastener 54 for fastening together the first and second ends 52, 53 of the securing strap 50. The securing strap fastener 54 is a hook and loop fastener (i.e., Velcro). As best illustrated in FIG. 8, it can be shown that when the present invention has been folded four times, the first and second ends 52 and 53 of the securing strap 50 are fastened together, whereby the securing strap 50 defines a carrying strap 56.

In use, loose items are inserted into each of the side pockets 30 and the side pockets 30 are closed at the side pocket opening 32 by the side pocket closure 34 thereby securely storing the items. As best illustrated in FIGS. 4 through 8, it can be shown that the blanket 20 is folded by first folding the side edges 26 inward such that the side edges 26 are abutted together on the top surface 22 of the blanket 20 (Folds 1 and 2). Next, the blanket 20 is folded in-half along a first axis perpendicular to the abutted side edges 26, whereby the top and bottom edges 24 and 25 are folded toward each other (Fold 3). The blanket is then folded in-half one more time along a second axis parallel to the first axis (Fold 4). Finally, the first and second ends 52, 53 of the securing strap 50 are fastened together by the securing strap fastener 54. Once fastened, the securing strap 50 defines a carrying strap 56 which can be used by a person to carry the present invention over the person's shoulder or on their back like a backpack. To unfold the blanket 20, the steps outlined above are performed in reverse order. When the present invention is unfolded and completely opened, a pillow 2 is inserted into the pillow pocket 40 and the pillow pocket 40 is closed at the pillow pocket opening 42 by the pillow pocket closure 44 thereby securely retaining the pillow 2. The pillow 2 may be inflatable.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Blanket With Pockets comprising:

a blanket having top and bottom surfaces, top and bottom edges, and side edges;

a plurality of side pockets provided on said top surface along an entire length of each of said side edges of said blanket;

a pillow pocket provided on said top surface along said top edge of said blanket;

an inflatable pillow disposed within said pillow pocket; and a securing strap attached to said bottom surface of said blanket, said securing strap having first and second ends, said first end extending beyond said top edge of said blanket and said second end extending under said bottom surface of said blanket, said blanket sequentially foldable along a pair of spaced parallel longitudinal axes, along a first transverse axis intermediate said top and bottom edges, and along a second transverse axis intermediate said top edge and said first transverse axis to a portable form, said first and second ends of said securing strap joinable by a securing strap fastener when said blanket has been folded to said portable form, said securing strap retaining said blanket in said portable form and forming a carrying strap when said first and second ends are joined together by said securing strap fastener.

2. The Blanket With Pockets of claim 1, wherein each of said plurality of side pockets includes a side pocket opening and a side pocket closure for securely closing said side pocket opening.

3. The Blanket With Pockets of claim 2, wherein said side pocket closure is a hook and loop fastener.

4. The Blanket With Pockets of claim 1, further comprising a second pillow pocket provided on said top surface along said bottom edge of said blanket.

5. The Blanket With Pockets of claim 1, wherein said pillow pocket includes a pillow pocket opening and a pillow pocket closure for securely closing said pillow pocket opening.

6. The Blanket With Pockets of claim 5, wherein said pillow pocket closure is a hook and loop fastener.

7. The Blanket With Pockets of claim 1, wherein said securing strap fastener is a hook and loop fastener.

8. The Blanket With Pockets of claim 1, further comprising a bottom surface pocket provided on said bottom surface of said blanket.

9. The Blanket With Pockets of claim 8, wherein said bottom surface pocket includes a bottom surface pocket opening and a bottom surface pocket closure for securely closing said bottom surface pocket opening.

10. The Blanket With Pockets of claim 9, wherein said bottom surface pocket closure is a hook and loop fastener.

11. A multipurpose blanket, comprising:

a generally rectangular textile member having a top surface and a bottom surface, a top edge and a bottom edge, and a pair of side edges, said textile member having a medial longitudinal axis equidistant said pair of side edges, a first longitudinal axis intermediate said medial longitudinal axis and a first of said pair of side edges, and a second longitudinal axis intermediate said medial longitudinal axis and a second of said pair of side edges;

a plurality of side pockets provided on said top surface of said textile member along an entire length of each of said pair of side edges thereof, each of said plurality of side pockets having a side pocket opening and including a side pocket closure for securely closing said side pocket opening;

a first pair of pillow pockets provided on said top surface of said textile member along said top edge thereof, each of said first pair of pillow pockets having a pillow pocket opening and including a pillow pocket closure for securely closing said pillow pocket opening;

a first pair of inflatable pillows each disposed within one of said first pair of pillow pockets; and a pair of securing straps each attached to said bottom surface of said textile member, each of said pair of securing straps having a first end and a second end, said first end extending beyond said top edge of said textile member and said second end extending under said bottom surface of said textile member, a first of said pair of securing straps longitudinally extending along said textile member intermediate said medial longitudinal axis and said first longitudinal axis, and a second of said pair of securing straps longitudinally extending along said textile member intermediate said medial longitudinal axis and said second longitudinal axis, said textile member foldable to a portable form wherein said textile member is sequentially foldable along said first longitudinal axis, along said second longitudinal axis, along a first transverse axis intermediate said top edge and said bottom edge, and along a second transverse axis intermediate said top edge and said first transverse axis, said first end and said second end of each of said pair of securing straps joinable by a securing strap fastener when said textile member has been folded to said portable form, said pair of securing straps retaining said textile member in said portable form and forming a pair of carrying straps when said first end and said second end of each of said pair of securing straps are joined together by said securing strap fastener.

12. The multipurpose blanket of claim 11, further comprising:

a second pair of pillow pockets provided on said top surface of said textile member along said bottom edge thereof, each of said second pair of pillow pockets having a pillow pocket opening and including a pillow pocket closure for securely closing said pillow pocket opening, and a second pair of inflatable pillows each disposed within one of said second pair of pillow pockets.

13. The multipurpose blanket of claim 11, further comprising:

a bottom surface pocket provided on said bottom surface of said textile member, said bottom surface pocket provided intermediate said first longitudinal axis and said second longitudinal axis and intermediate said second transverse axis and said top edge whereby said bottom surface pocket remains accessible when said textile member has been folded to said portable form, said bottom surface pocket having a bottom surface pocket opening and including a bottom surface pocket closure for securely closing said bottom surface pocket opening.

* * * * *